US005690217A

United States Patent [19]

Friday

[11] Patent Number: 5,690,217

[45] Date of Patent: Nov. 25, 1997

[54] MOVABLE COMPARTMENTALIZED LAUNDRY STORAGE UNIT

[76] Inventor: Sara A. Friday, 4350 Hillcrest Dr. Apt. No. 301, Hollywood, Fla. 33021

[21] Appl. No.: 672,476

[22] Filed: Jun. 26, 1996

[51] Int. Cl.[6] ..... B65D 85/18

[52] U.S. Cl. ..... 206/278; 220/532; 220/909; 190/115

[58] Field of Search ..... 206/278; 220/503, 220/504, 532, 533, 523, 524, 909, 252; 190/18 A, 115, 117, 118

[56] References Cited

U.S. PATENT DOCUMENTS

| | | | |
|---|---|---|---|
| D. 142,275 | 8/1945 | Kohen | 220/909 |
| D. 142,649 | 10/1945 | Kohen | 220/909 |
| 1,043,572 | 11/1912 | Donley . | |
| 1,498,322 | 6/1924 | Hyams . | |
| 2,013,782 | 9/1935 | McElmoyl . | |
| 2,384,873 | 9/1945 | Barksdale . | |
| 2,653,826 | 9/1953 | Lu . | |
| 2,895,782 | 7/1959 | Fragale | 220/909 |
| 3,606,372 | 9/1971 | Browning . | |
| 3,720,346 | 3/1973 | Cypher | 220/909 |
| 3,958,715 | 5/1976 | Capelli | 220/532 |
| 4,036,336 | 7/1977 | Burtley | 190/115 |
| 4,813,520 | 3/1989 | Lin . | |
| 5,147,055 | 9/1992 | Samson et al. | 220/252 |
| 5,167,306 | 12/1992 | Carrigan, Jr. | 190/115 |
| 5,219,085 | 6/1993 | Craft et al. | 220/252 |
| 5,356,024 | 10/1994 | Ho et al. . | |
| 5,464,113 | 11/1995 | Ho et al. . | |
| 5,484,078 | 1/1996 | Bronovicki | 220/909 |
| 5,524,737 | 6/1996 | Wang | 190/115 |

FOREIGN PATENT DOCUMENTS

| | | | |
|---|---|---|---|
| 0119918 | 4/1901 | Germany | 220/252 |

*Primary Examiner*—David T. Fidei
*Attorney, Agent, or Firm*—Malin, Haley, DiMaggio & Crosby, PA

[57] ABSTRACT

A movable laundry storage unit is provided which generally comprised of a rigid body member having a closed bottom and an open top end and defining a clothing and article storage area. A pair of wheel members are preferably attached to the bottom of the body member and handle member is attached to the back portion of the body member. The storage unit can be provided with one or more dividers for sectioning the storage area into two or more compartments. A cover member is also provided to prevent any stored clothing or articles from falling out of the storage area while the storage unit is in transit.

11 Claims, 4 Drawing Sheets

MOVABLE COMPARTMENTALIZED LAUNDRY STORAGE UNIT

BACKGROUND OF THE INVENTION

1. Field of the Invention

The invention relates to the field of laundry containers, more particularly, for the storage and movement of laundry awaiting laundering, which can be divided so that clothes can be sorted, that has a handle and wheels so that laundry can be moved and that is constructed in an attractive manner as to fit with any decor of any home.

2. Description of the Prior Art

Hampers for dirty laundry are often found in households. However, conventional hampers are stationery items which reside in a single location within the house or apartment, often a bathroom. Often, the accumulated dirty laundry is cleaned at a location other than the person's residence, such as a laundromat or dry cleaner. Additionally, even when dirty laundry is cleaned at home, due to certain layouts of the residence, the laundry is required to be moved to and from various locations in the house from where the washer and dryer are located.

Where laundry is to be cleaned at a remote location, other than the person's residence, the person often removes the dirty laundry out of the hamper and into a bag or pillowcase for transporting. Additionally, when washing laundry at home, after washing, the laundry is often placed into a movable laundry basket and distributed. Thus, even where a person's washes his or her laundry at home, a hamper and a separate laundry basket is often utilized, requiring enough storage space for both the hamper and the laundry basket. Additionally, conventional laundry baskets do not provide for separating clothes. Thus, the clean clothing is not separate per room prior to distributing, and instead the user must search the entire laundry basket for clothing or articles for each intended room (i.e. first child's laundry, second child's laundry, parent's laundry, bathroom laundry, etc.).

Furthermore, hampers often contain various types of dirty laundry, including, dirty clothing, wet towels, socks, fine washables, etc. Conventional hampers require that the various types of dirty laundry be mixed together. Thus, the mixing of wet clothing or towels can cause damage to the other dirty articles placed in the hamper.

Though not addressing, nor solving the problems identified above, containers for transporting clothing include U.S. Pat. No. 1,498,322 issued to Hyams; U.S. Pat. No. 2,013,782 issued to McElmoyl; U.S. Pat. No. 2,384,873 issued to Barksdale; and U.S. Pat. Nos. 5,356,024 and 5,464,113 issued to Ho et al.

Hyams discloses a collapsible clothes cabinet, which is provided with casters so that the assembled cabinet may be moved around as desired and which provides storage of clean clothing.

McElmoyl discloses a shipping hamper which is used for either local or long-distance transportation of coats, dresses, or the like, in which the articles are supported by hangers.

Barksdale discloses a laundry vehicle which may be folded into a small and compact unit when not in use.

Ho discloses a collapsible hamper for storage of laundry and other items. When in use, the hamper is stationary and not transportable. The hamper can be disassembled and collapsed for storage purposed when not in use.

Thus, some of the problems with the prior art is the failure to separate dirty and/or clean laundry, to prevent damage to at least some of the laundry, as well as providing an easily transportable hamper. These advantages should be provided with minimal, if any, affect to the outer viewable portion of the unit, as compared to conventional hampers. It is therefore, to the effective resolution of the aforementioned problems and shortcomings that the present invention is directed.

SUMMARY OF THE INVENTION

The present invention relates to a compartmentalized movable laundry storage unit, which can safely store laundry of all types, including, but not limited to fine washables, dry cleaning, damp color items, along with damp white items, and the like, within one unit. The unit generally includes a body member defining a laundry storing area, a cover member, and means for easily transporting the unit from a first location to a second location, even if the second location is at a remote cite, such as a laundromat or dry cleaners. The body member can be provided with one or more divider members, for providing separate compartments within the laundry storing area, thus, allowing the user to separate the dirty laundry to reduce damage to the laundry.

The body member preferably forms a cubic rectangle having an open upper end and a closed bottom end and is preferably constructed from a rigid material. A domed or circular cover is, preferably, hingedly connected at the back top of the body member, to allow the cover to be rotated from a closed position to an open position. The cover member is also preferably constructed from a rigid material.

The means for transporting preferably includes at least one wheel member associated with the bottom of the body member and a handle member associated with the back portion of the body member. Preferably, two wheel members are provided. The movable storage unit is also preferably provided with means for positioning the handle member either in a retractable position or an extended position.

A rigid skirt member can also be associated with the bottom of the unit and is positioned at the front portion of the unit and extends from side to side. The skirt member hides the wheel members when viewing the unit from the front, as well acting as a resting means for the unit. In lieu of the skirt member, a pair of rigid legs or stub members can be disposed at each side of the front of the unit and attached to the bottom of the body member. The rigid leg members also act as resting means for the unit, but do not conceal the wheel members.

The cover member is sufficiently domed or circular to block the view of the handle to a viewer looking from the front of the unit, thus, allowing the unit to appear similar to a conventional stationary hamper.

The handle member is preferably provided with a locking mechanism, for maintaining the handle member in a retracted position and/or extended position. When it is desirable to move the unit, the locking mechanism is released allowing the handle to extend upwards, by the expansion of spring members, disposed within the handle housings, which are compressed while the handle member is in its retracted position.

A handle safety latch or strap can also be provided to prevent accidental extensions of the handle member from its retracted position within the handle housing. The strap can be permanently attached to the body member at a first end and removably attached to the body member at a second end. The strap member is tightly positioned over the handle member and attached at its second end to the body member by conventional means, i.e. snaps, hook and loop fasteners, buttons, etc. Once properly attached to the body member the strap member prevents the handle member from moving to its extended position.

A plurality of protrusions are disposed on the inner surface of the body member to define divider retaining pathways. Each protrusion preferably has a corresponding aligned protrusion which define a portion of the pathway therebetween. Thus, horizontal and vertical divider pathways are preferably provided on the inner surface of the body member for retaining and holding one or more divider members. The dividers may be added or removed as desired by the user. The dividers are provided to divide the unit into a plurality of compartments. Each divider is preferably sufficient in length and width to be properly disposed and maintained within a pathway defined by a plurality of the protrusions.

The unit can be configured as to provide from one to five compartments. When one compartment is desired no dividers are provided. If two compartments are desired, a single divider is maintained in either a vertical position or a horizontal position by associated protrusions to achieved the desired result. To achieve more than two compartments, a variety of horizontal and vertical divider arrangements can be utilized.

The horizontally disposed dividers preferably either expand approximately the full width of the body member or half the width of the body member. Similarly, the vertically disposed dividers preferably either extend approximately the full height of the body member or half the height of the body member. Furthermore, preferably all of the dividers when properly disposed are approximately the same depth as the body member to prevent the disposed clothing from escaping its designated compartment within the storage area defined by the body member. Furthermore, the dividers also preferably create at least a substantially sealed relationship between adjacent compartments to prevents fluids and dirts associated with clothing in one compartment from damaging clothing stored in another compartment of the unit.

The body member can also be provided with a door member which can be disposed on the front or the back of the body member. The door member allows access to the lower area of the body member, which would otherwise be unaccessible when utilizing a horizontal divider, without having to remove any clothing or articles disposed in the top portion of the body member and the horizontal divider. The door member is maintained in a closed position by conventional means, such as magnets, and is hingedly connected to the bottom of the body member.

When a divider is not needed it can be disposed at the bottom of the body member to prevent the divider from accidentally becoming lost. Each divider can be preferably provided with a flap member attached thereto for facilitating removal of the divider from the bottom of the hamper.

When moving the storage unit for whatever purposes, the handle member is preferably moved to its extended position as described above. However, it should be understood that, though not preferred, the storage unit can also be moved with the handle member in its retracted position. In either handle position, the storage unit is tilted back with the handle onto its wheels allowing the storage unit to be transported to a vehicle for taking the dirty clothes to a laundromat or dry cleaners, for transporting the storage unit around the house for distributing clean clothes, for transporting the storage unit from its stationary location in the house to the area of the house where the washer and dryer are located, etc.

The use of the movable compartmentalized laundry storage unit can be similar to the known art for the simple storage of laundry, however, the present invention can also be utilized in many ways which are not possible with conventional hampers. The variety of fabrics and colors of clothing worn by individuals is very diverse. Active life styles also lead to varying degrees of soilness to worn clothing. For these reasons, it is often desirable to have dirty laundry separated while waiting to be laundered. For example, one may not want to place a white silk shirt in a hamper next to a damp red face cloth. This could lead to staining of the silk shirt. The present invention allows a user to slide in one or more dividers to create two or more compartments for keeping garments separated.

Sufficient protrusions are placed on the interior of the storage unit to create pathways for receipt of the dividers which can create a variety of compartments of various sizes as desired by the user. Therefore all damp items can be kept separate from fine washables, while yet another compartment contains dry cleaning and yet another compartment contains under-garments. The arrangement of compartments is entirely up to the user and the compartments can be changed as storage needs change.

While the laundering is proceeding the compartments and dividers may be wiped down, if necessary, and the transporting unit can be used along with its compartments for sorting to bring the clean laundry back to the person's residence for distributing to various rooms at the residence.

Once the laundry is cleaned or distributed, the movable laundry storage unit can be placed back to stationary location in the residence for the accumulation of new dirty laundry. The handle member is retracted by manual means and held in its retracted position by the locking mechanism. The safety strap can be properly positioned and the user has a fully functional compartmentalized laundry storage unit which now can act as a conventional hamper or as a sectioned hamper for separating new disposed dirty laundry. The unit is attractive to the eye and fits into the interior decor of which the unit is located.

Accordingly, it is an object of the present invention to provide a movable compartmentalized laundry storage unit, which can safely store laundry of all types, including fine washables, dry cleaning, damp color items along with damp white items, and the like, within one unit without causing damage to any of the laundry.

It is another object of the present invention to provide a movable compartmentalized laundry storage unit, which can transport laundry easily from it storage place, typically within a clothes changing area, to a laundering area such as a laundromat or dry cleaners.

It is yet another object of the present invention to provide a movable compartmentalized laundry storage unit, which is attractive to the eye within a home's decor, especially when the unit is in a typical clothes changing area.

It is still another object of the present invention to provide a movable compartmentalized laundry storage unit, which consolidates the typical functions of a hamper and a laundry basket into one unit.

It is even still another object of the present invention to provide a movable compartmentalized laundry storage unit, which will allow the user to separate cloths, into the modularized compartments in advance, wherein the user can define the spacial parameters of the modularized compartments easily and as desired.

It is a further object of the present invention to provide a movable compartmentalized laundry storage unit, which may be facilitated in the transportation of clean cloths from the laundering area to the user's clean clothes storage areas.

In accordance with these and other objects which will become apparent hereinafter, the instant invention will now be described with particular reference to the accompanying drawings.

BRIEF DESCRIPTION OF THE DRAWINGS

The invention may be better understood by reference to the drawings in which.

DESCRIPTION OF THE PREFERRED EMBODIMENTS

Figure 1:
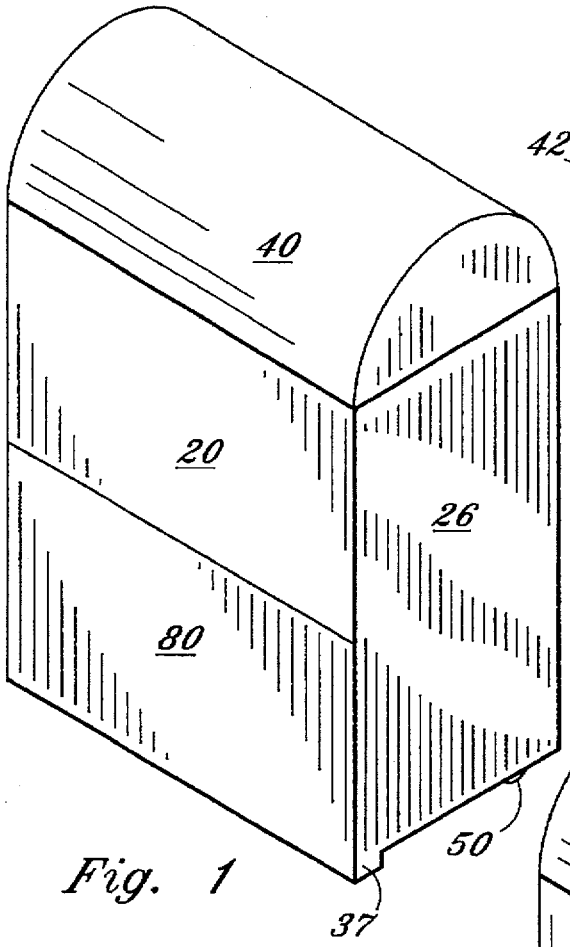
FIG. 1 is a front perspective view of the movable laundry storage unit of the present invention having a lower storage area access door.
Figure 6:
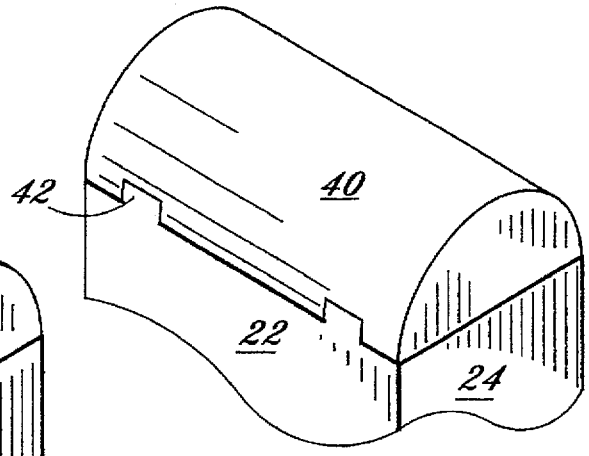
FIG. 6 is a perspective view of the top portion of the storage unit shown in FIG. 1 with the handle member and handle housing removed.
Figure 5:
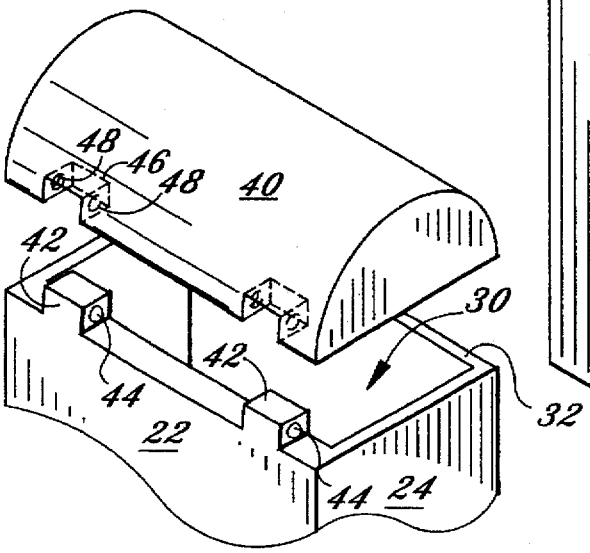
FIG. 5 is an exploded perspective view of the top portion of the storage unit shown in FIG. 1 with the handle member and handle housing removed.
Figure 2:
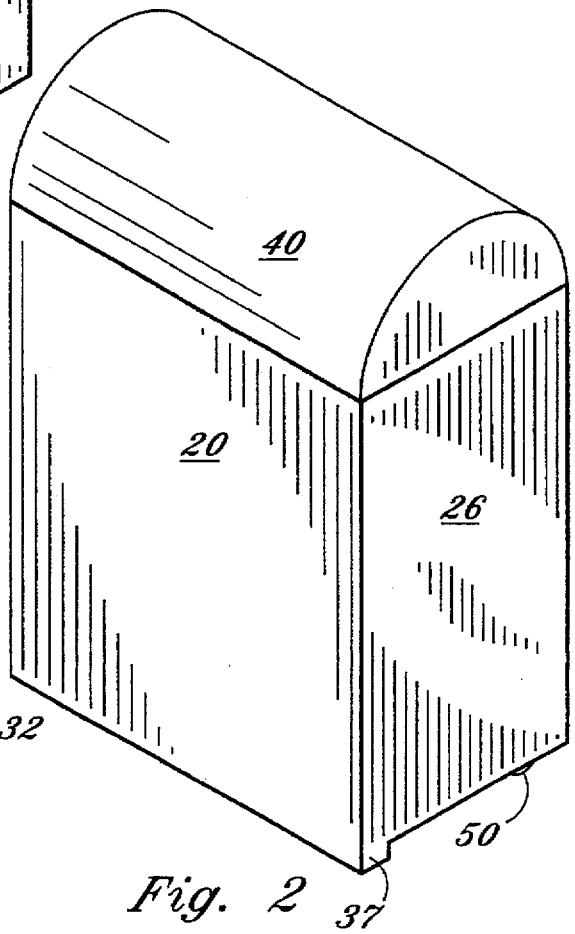
FIG. 2 is a front perspective view of the movable laundry storage unit of the present invention either without the lower storage area access door or with the access door associated with the back portion of the storage unit.
Figure 4:
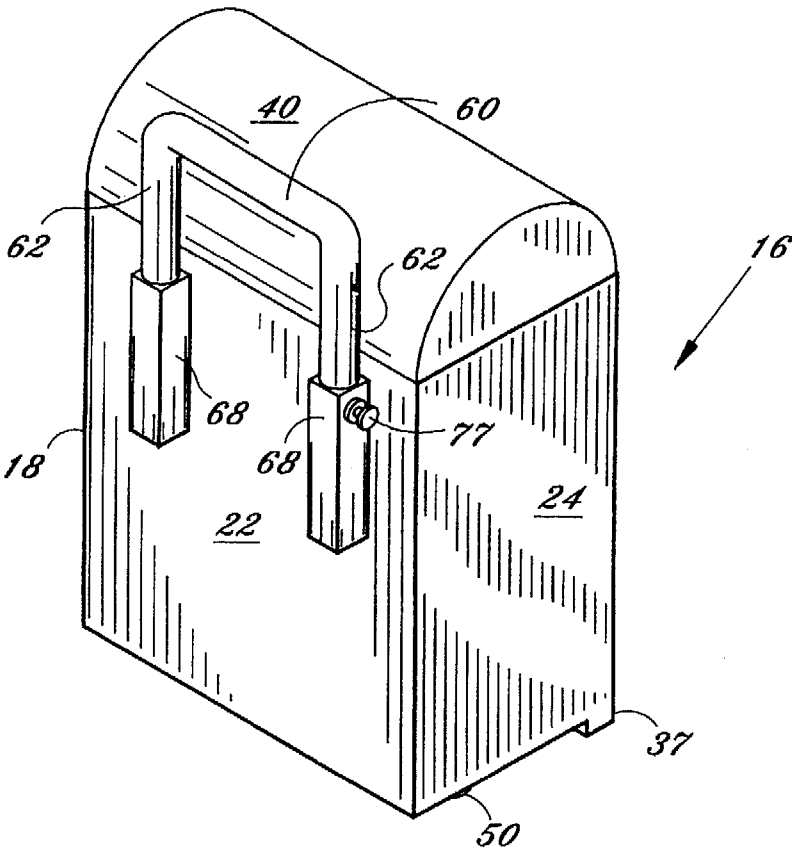
FIG. 4 is a back perspective view of the storage unit shown in FIG. 1.
Figure 3:
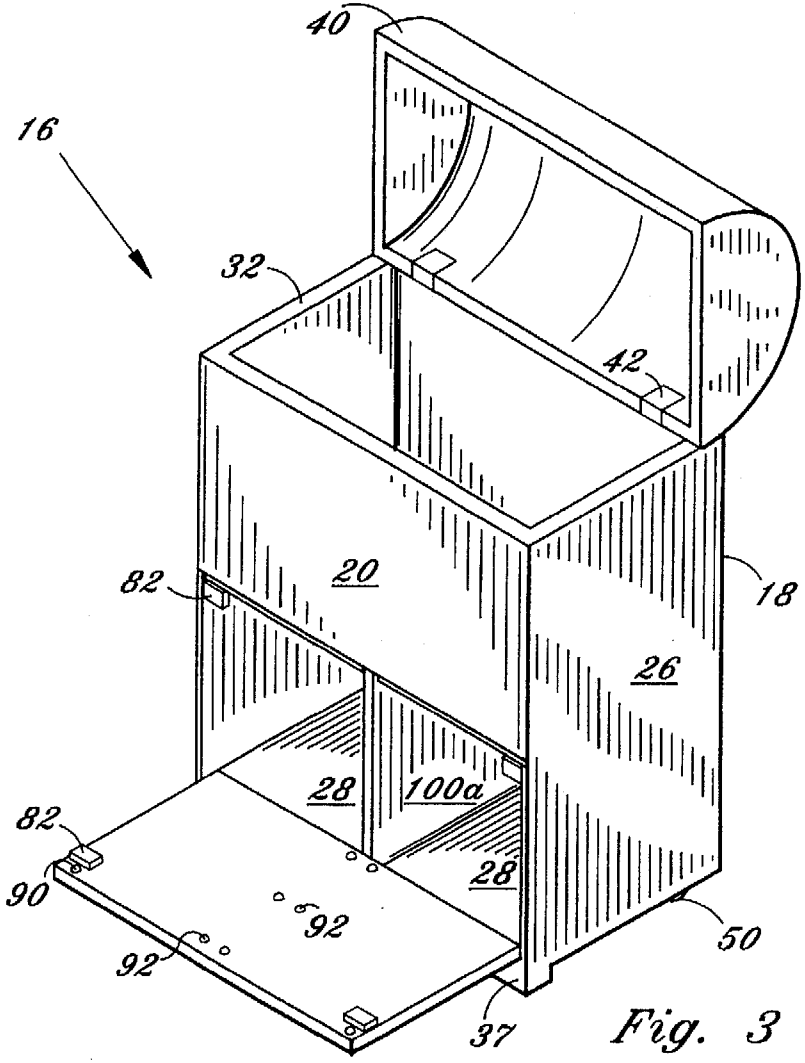
FIG. 3 is a front perspective view of the storage unit shown in FIG. 1.
Figure 7A:
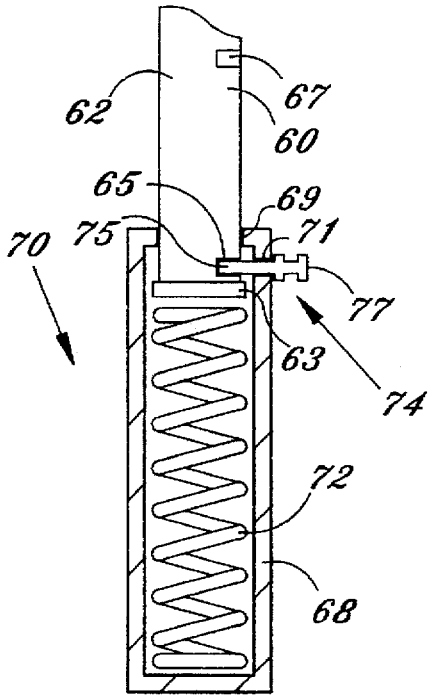
FIG. 7*a* is a sectional view of the handle housing and a portion of the handle member and illustrating the handle member in an extended position.
Figure 7B:
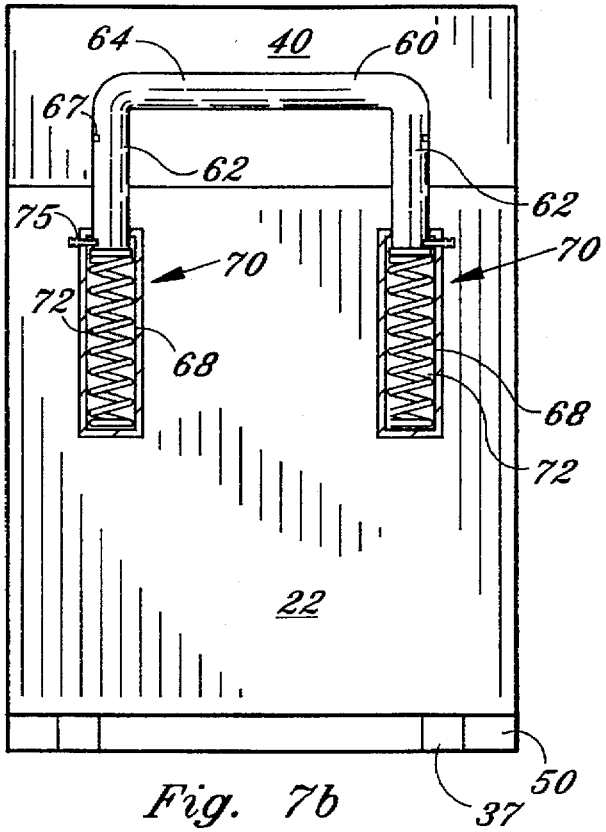
FIG. 7*b* is a back elevational view of the storage unit shown in FIG. 1 showing the handle housing in section and also illustrating the handle member in its extended position.
Figure 8A:
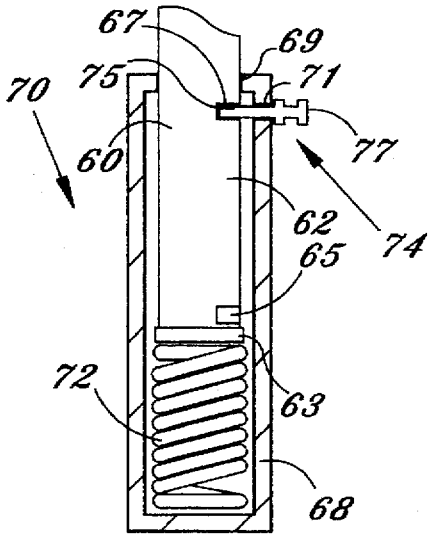
FIG. 8*a* is a sectional view of the handle housing and a portion of the handle member and illustrating the handle member in a retracted position.
Figure 8B:
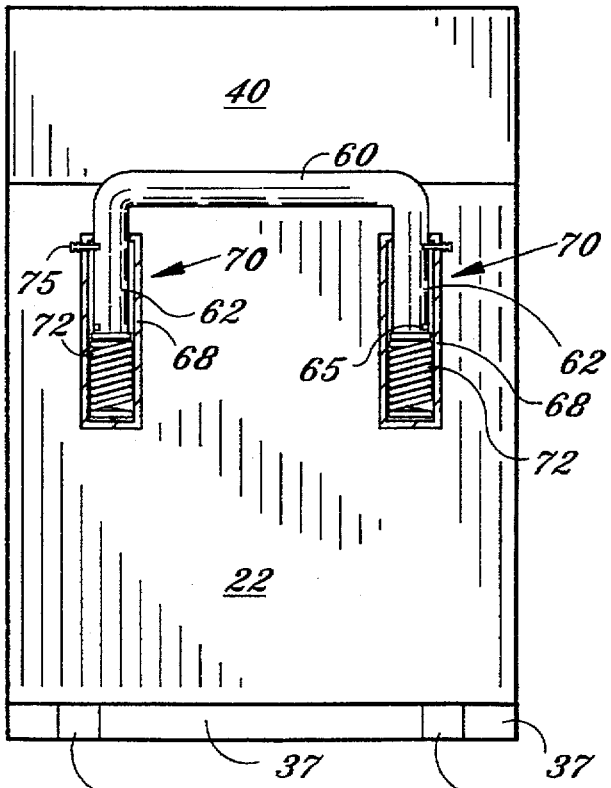
FIG. 8*b* is a back elevational view of the storage unit shown in FIG. 1 showing the handle housing in section and also illustrating the handle member in its retracted position.
Figure 11:
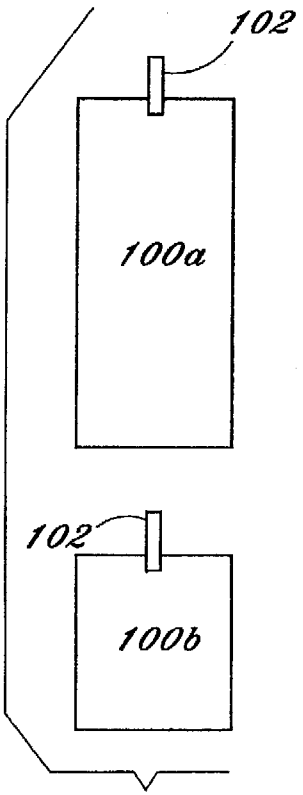
FIG. 11 is a front elevational view of a full length divider and a half length divider for use with the movable laundry storage unit in accordance with the present invention.
Figure 10:
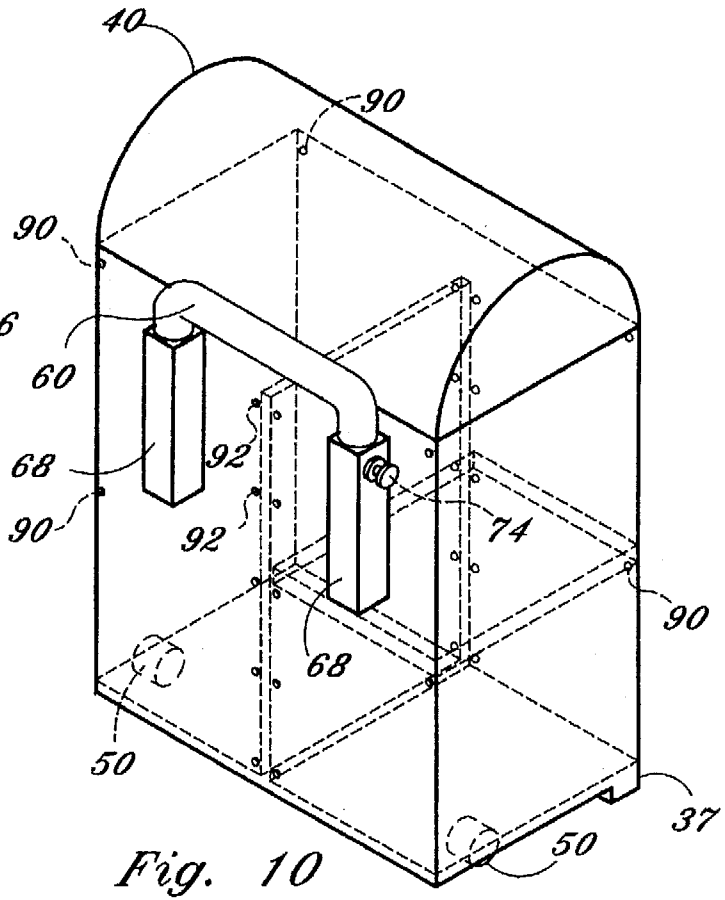
FIG. 10 is a back perspective view of the storage unit shown in FIG. 1 and showing the unit as being of a clear material to illustrate the inner structure of the storage unit.
Figure 9:
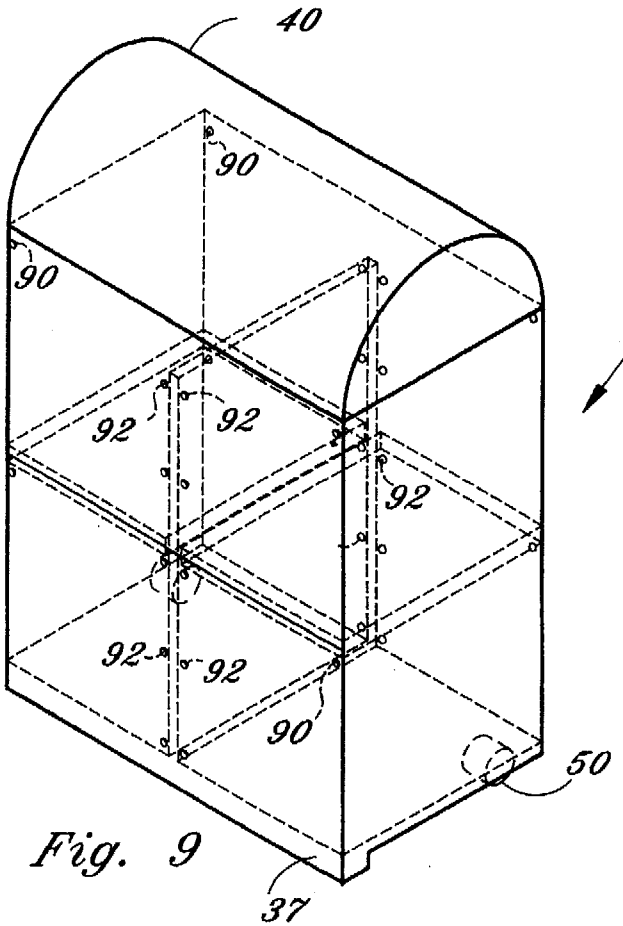
FIG. 9 is a front perspective view of the storage unit shown in FIG. 1 and with the handle member and handle housing removed and showing the unit as being of a clear material to illustrate the inner structure of the storage unit.

As seen in the drawings, a movable laundry storage unit in accordance with the present invention is illustrated and is generally referenced as storage unit 16. Storage unit 16 generally includes a body member 18, a cover member 40, and means for easily transporting the unit from a first location to a second location. Body member 18 includes a front wall 20, back wall 22, first side wall 24, second side wall 26 and a closed bottom end 28. A laundry storage area 30 is defined by body member 18. The body member can be provided with one or more divider members 100, for providing separate compartments within laundry storage area 30.

Preferably, body member 18 forms a cubic rectangle having an open upper end 32 and a closed bottom end 28. However, it should be understood that other shapes for body member 18 are possible and are considered within the scope of the invention. Body member 18 is preferably constructed from a rigid material such as plastic or can be also constructed from any conventional material normally utilized to construct conventional hampers.

Domed or circular cover 40 is in contact with and covers open upper end 32 of body member 18. Preferably, cover 40 is hingedly connected at the back of top end 32, to allow cover 40 to be rotated from a closed position to an open position. In one connection embodiment, male members 42 having protrusions 44 are provided at the back of top end 32 for mating with female receiving members 46 having protrusion receiving cavities When properly connected protrusions 44 are firmly received and retaining within corresponding cavities 48.

Cover member 40 is also preferably constructed from a rigid material such as plastic or can be also constructed from any conventional material normally utilized to construct conventional hampers or hamper covers.

The means for transporting preferably includes at least one wheel member 50 associated with bottom end 28 of body member 18 and a handle member 60 associated with back wall 22 of body member 18.

Storage unit 16 is also preferably provided with means for positioning 70 handle member 60 either in a retractable position or an extended position.

Preferably two wheel members 50 are provided, though such is not limiting. It should be understood that the terminology wheel members is intended to also include rollers, castors, etc. Wheel members 50 are in connection with, and extend down from, bottom surface 28 of body member 18. Each wheel member 50 is located at the bottom of storage unit 16 towards each side of body member 18 and also towards the back of body member 18.

A rigid skirt member 37 can also be associated with the bottom of storage unit 16 and is positioned at the front portion of storage unit 16 and extends from side to side of body member 18. Preferably, skirt member is constructed integral with body member 18. Skirt member 37 hides wheel members 50 when viewing movable storage unit 16 from the front, as well acting as a resting means for storage unit 16 when unit 16 is stationary. In lieu of skirt member 37, a pair of rigid legs or stub members (not shown) can be disposed at each side of the front of storage unit 16 and attached to the bottom of body member 18. The rigid leg members also act as resting means for the unit, but do not conceal the wheel members. Skirt member 37 and/or the leg members are preferably constructed from a plastic material, though such is not limiting and other materials which will provide a rigid member can also be utilized and are considered within the scope of the invention.

Cover member 40 is sufficiently domed or circular to block the view of handle member 60 to a viewer looking from the front of the unit, thus, allowing movable laundry storage unit 16 to appear similar to a conventional stationary hamper. The domed or circular shape of cover member 40 also provides additional storage area within cover member 40, when cover member 40 is in a closed position. This additional storage area is in communication with storage area 30 of body member 18.

Handle extending means, preferably spring members 72, are respectively located within corresponding handle housings 68. Handle member 60 is preferably "U" shaped having leg members 62 and a gripping member 64. Each leg member 62 of "U" shaped handle member 60 is at least partially disposed within a corresponding handle housing 68. The disposed ends 63 of leg members 62 are greater in diameter as compared to the remaining portion of the leg members 62 and openings 69 at the top of handle housings 68, to prevent leg members 62 from being completely removed out of their respective handle housings 68, when in an extended position.

Handle member 60 is provided with a locking mechanism 74, for maintaining handle member 60 in at least a retracted position and can also be constructed to maintain handle member 60 in its extended position. When it is desirable to move the unit, locking mechanism 74 is released allowing handle member 60 to extend upwards, by the expansion of spring members 72, disposed within handle housings 68, which are compressed while handle member 60 is in its retracted position. In its upward position, handle member 60 is easily grasped at its gripping portion 64 by the user, however, it should be understood that handle member 60 could also be grabbed in its retracted position, though not preferred.

Locking mechanism 74 is conventional and in one embodiment can include a pin member 75 which is inserted through an aperture 71 extending through handle housings 68 and through an aperture 67 or 65 in handle member 60. When in its proper retracted position, the two apertures 65 and 71 are aligned allowing pin member 75 to be properly inserted through both to retain handle member 60 in a retracted position. Preferably, apertures 71, 67 and 65 are provided through both handle housings 68 and through both leg members 62 of handle member 60. However, handle member 60 can be maintained in its retracted position by an aperture 71 and 65 in only one of handle housings 68 and a corresponding handle leg member 62, respectively. Additionally, a second aperture 67 can be provided in both leg members 62 of handle member 60 which is aligned with aperture 71 of respective handle housings 68 when handle member 60 is in its proper extended position. Similar to above, pin member 75 could be inserted through both apertures 71 and 67 to maintain handle member 60 in its extended position. Likewise, this feature can also be accomplished with apertures 67 and 71 associated with only leg member 62 and handle housing 68, respectively.

Pin member 75 can be provided with a stop means (not shown) to prevent pin member 75 from being completely withdrawn from within corresponding handle housing 68, which helps to prevent inadvertently losing pin member 75. Alternatively, pin member 75 could be associated with a chain, rope, string, etc. (not shown) which is attached either to body member 18 or a respective handle housing 68. Additionally, pin member 75 is also preferably provided with a gripping member 77 for ease of inserting pin member 75 into its associated apertures 65, 67 and/or 71.

Pin member 75 can be constructed from any rigid material, and is preferably constructed from a metal material such as stainless steel. Handle member 60 and handle housing 68 can be constructed from various rigid materials including, plastics, metals, etc. Handle housings 68 can also be constructed integral with body member 18.

A handle safety latch or strap (not shown) can also be provided to prevent accidental extensions of handle member 60 from its retracted position within handle housing 68. The strap can be permanently attached to body member 18 at a first end and removably attached to body member 18 at a second end. The strap member is tightly positioned over handle member 60 and attached at its second end to body member 18 by conventional means, i.e. snaps, hook and loop fasteners, buttons, etc. Once properly attached to body member 18 the strap member prevents handle member 60 from moving to its extended position.

A plurality of protrusions 90 and 92 are disposed on the inner surface of body member 18. Protrusions 92 define divider retaining pathways. Protrusions 92 preferably have a corresponding aligned protrusion 92 which define a portion of the pathway therebetween. Thus, horizontal and vertical divider ledges and pathways, respectively, are preferably provided on the inner surface of body member 18 for retaining and holding one or more divider members 100*a* or 100*b*. Dividers 100 may be added or removed as desired by the user. Dividers 100 are provided to divide storage unit 16 into a plurality of compartments. Each divider 100 is preferably sufficient in length and width to be properly disposed and maintained within a pathway or ledge defined by a plurality of protrusions 92 or 90, respectively.

Storage unit 16 can be preferably configured as to provide from one to five compartments. However, this number is not limiting and by the disposal of protrusion 90 and/or 92 at various locations along the inner surface of body member 18 it is possible to configure dividers 100 in such manner as to provide for even more than five compartments.

When one compartment is desired no dividers are provided. If two compartments are desired, a single divider 100*a* is maintained in either a vertical position or a horizontal position by associated protrusions 92 or 90, respectively, to achieved the desired result. Protrusions 90 should be sufficient in strength to withstand, not only the weight of divider 100, but also the weight of a relatively large amount of clothing or other articles which are disposed on top of horizontally mounted divider 100, to assure that divider 100 does not collapse due to the relatively large amount of weight it possibly is supporting.

Divider members 100 are preferably constructed from a rigid plastic although other materials which will provided for relatively rigid divider and which will prevents any fluids or dirt in a compartment from entering adjacent compartments can be utilized and are considered within the scope of the invention. Preferably, protrusions 90 and/or 92 are constructed integral with body member 18 and are of the same material. However, such is not limiting and protrusions 90 and/or 92 can be of another rigid material which differs than the material of body member 18 and can be attached to the inner surface of body member 18 by conventional means such as adhesives, etc.

In lieu of protrusions the inner surface of walls 20, 22, 24, 26 and/or 28 of body member 18 can be provided with grooves (not shown) adjacent where the various pathways and ledges defined by protrusions 92 and 90, respectively, are normally located. The groove(s) provided for maintaining divider 100 in a horizontal position should be sufficient in depth to receive enough of divider 100 to withstand, not only the weight of divider 100, but also the weight of a relatively large amount of clothing or other articles which are disposed on top of the horizontally mounted divider 100, so divider 100 does not collapse due to the relatively large amount of weight it possibly is supporting.

The horizontally disposed dividers 100 preferably either expand approximately the full width (divider 100*a*) of body member 18 or half the width (100*b*) of body member 18. Similarly, the vertically disposed dividers 100 preferably either extend approximately the full height (100*a*) of body member 18 or half the height (100*b*) of body member 18. Furthermore, preferably dividers 100 when properly disposed are approximately the same depth as body member 18 to prevent the disposed clothing from escaping its designated compartment within storage area 30 defined by body member 18. However, depending on the location of protrusions 90 and/or 92 other sizes for dividers 100 can be utilized to provide a plurality of compartment configurations.

Furthermore, dividers 100 also preferably create at least a substantially sealed relationship between adjacent compartments to prevents fluids and dirts associated with clothing in one compartment from damaging clothing stored in another compartment of storage unit 16.

Body member 18 can also be provided with a door member(s) 80 which can be disposed or associated with the front and/or back portion(s) of body member 18. Preferably only a single door member 80 is provided at the front or back portion of body member 18, however, it is within the scope of the invention to provide a door member 80 at both the front and back portion. Door member 80 allows access to the lower portion of storage area 30, which would otherwise be unaccessible when utilizing a horizontally disposed divider 100, without having to remove any clothing or articles disposed in the top portion of storage area 30 and horizontal divider 100.

Door member 80 is maintained in a closed position by conventional means, such as magnets 82, and is hingedly connected to the bottom of body member 18. In lieu of magnets 82 other conventional connection means can also be utilized such as hook and loop fasteners, snaps, etc. However, with the use of these alternative connection means a small handle member (not shown) attached to door member 80 may also be required when opening door member 80 to gain access to the lower area of body member 18.

When divider(s) 100 are not needed they can be disposed at the bottom of body member 18 to prevent divider(s) 100 from accidentally becoming lost. Each divider 100 can be preferably provided with a flap or strap member 102 attached thereto for facilitating removal of divider 100 from the bottom of body member 18.

When moving storage unit 16 for whatever purposes, handle member 60 is preferably moved to its extended position as described above. However, it should be understood that, though not preferred, storage unit 16 can also be moved with handle member 60 in its retracted position. In either handle position, storage unit 16 is tilted back with handle member 60 onto wheel members 50 allowing storage unit 16 to be transported.

Sufficient protrusions 90 and 92 are placed on the interior of body member 18 to create ledges and pathways, respectively, for receipt of dividers 100 which can create a variety of compartments of various sizes as desired by the user. Therefore all damp items can be keep separate from fine washables, while yet another compartment contains dry cleaning and yet another compartment contains undergarments. The arrangement of compartments is entirely up to the user and the compartments can be changed as storage needs change. The size of storage unit 16 can be preferably constructed to be consistent with or similar to conventional hampers. However, such is not limiting and storage unit 16 can be constructed in an endless amount of sizes.

What I claim is:

1. A movable laundry storage unit comprising:

a relatively rigid body member, having a closed bottom and an open top end, said body member defining a clothing and article storage area;

a pair of wheel members attached to a back bottom area of said body member;

a handle member attached to a back portion of said body member;

a handle housing attached to the back portion of said body member; a portion of said handle member being disposed within said handle housing;

one or more removable dividers positioned either vertical or horizontal within said storage area as desired by a user to section the storage area of said body member into two or more compartments, inner surfaces of said body member being provided with a plurality of protrusions which define pathways for the receipt and support of said dividers in their horizontal or vertical positions, said dividers creating a substantially sealed relationship between adjacent compartments;

a door member for accessing a lower storage area of said body member, said door member disposed at a lower portion of said body member and hingedly connected to the bottom end of said body member; and cover means for preventing clothing and other articles disposed within said body member from falling out of said body member while said body member is in transit, said cover means also providing an additional storage area;

wherein said handle member is moved outward from the handle housing to an extended position when moving said body member and is in a retracted position with respect to the handle housing when said body member is in a stationery position;

wherein said cover member also concealing said handle member, at least in its retracted position, when viewing said body member from a front area;

wherein said storage unit can be utilized as either a hamper or laundry basket.

2. A movable laundry storage unit comprising:

a relatively rigid body member having a closed bottom and an open top end, said body member defining a clothing and article storage area;

at least one wheel member attached to the closed bottom end of said body member;

a handle member attached to a back portion of said body member;

one or more removable dividers positioned either vertical or horizontal within said storage area as desired by a user to section the storage area of said body member into two or more compartments;

cover means for preventing clothing and other articles disposed within said body member from falling out of said body member while said body member is in transit;

wherein a portion of said handle member is disposed within a handle housing attached to the back portion of said body member;

wherein said handle member is moved outward from the handle housing to an extended position when moving said body member and is in a retracted position with respect to the handle housing when said body member is in a stationery position; and further including means for preventing inadvertent extension of said handle member out of said handle housing.

3. The movable laundry storage unit of claim 2 wherein said cover member is substantially dome shaped to provide for an additional storage area and also to conceal said handle member when viewing said body member from a front area.

4. The movable laundry storage unit of claim 2 wherein inner surfaces of said body member are provided with a plurality of protrusions which to define pathways for the receipt and support of said dividers in their horizontal or vertical positions.

5. The movable laundry storage unit of claim 2 further including a door member for accessing a lower storage area of said body member, said door member disposed at a lower portion of said body member and hingedly connected to the bottom end of said body member.

6. The movable laundry storage unit of claim 1 further including a pin member associated with said handle housing and said handle member for maintaining said handle member in either its extended position or its retracted position.

7. The movable laundry storage unit of claim 2 further including a rigid skirt member attached to a front bottom area of said body member and concealing said at least one wheel member when viewing said body member from a front area.

8. The movable laundry storage unit of claim 2 further including at least one leg member attached to a front bottom area of said body member.

9. The movable laundry storage unit of claim 2 further including means for maintaining said handle member in either its extended or retracted position.

10. The movable laundry storage unit of claim 6 further including means for preventing inadvertent extension of said handle member out of said handle housing.

11. A movable laundry storage unit comprising:

relatively rigid body member having a closed bottom and an open top end, said body member defining a clothing and article storage area;

at least one wheel member attached to the closed bottom end of said body member;

a handle member attached to a back portion of said body member;

one or more removable dividers positioned either vertical or horizontal within said storage area as desired by a user to section the storage area of said body member into two or more compartments;

cover means for preventing clothing and other articles disposed within said body member from falling out of said body member while said body member is in transit; and further including means for preventing inadvertent extension of said handle member out of said handle housing;

wherein a portion of said handle member is disposed within a handle housing attached to the back portion of said body member;

wherein said handle member can be moved outward from the handle housing to an extended position when moving said body member and can be in a retracted position with respect to the handle housing when said body member is in a stationery position.

* * * * *